United States Patent [19]

Kalitzki et al.

[11] Patent Number: 4,928,477

[45] Date of Patent: May 29, 1990

[54] PROCESS FOR FORMING A FIBER OR YARN CONTACTED ELEMENT OF A TEXTILE MACHINE

[75] Inventors: Siegfried Kalitzki, Würselen-Bardenberg; Josef Peters, Geilenkirchen-Grot, both of Fed. Rep. of Germany; Gottfried Schürmann, JG Schinveld, Netherlands

[73] Assignee: W. Schlafhorst & Co., Fed. Rep. of Germany

[21] Appl. No.: 331,638

[22] Filed: Mar. 30, 1989

[30] Foreign Application Priority Data

Mar. 30, 1988 [DE] Fed. Rep. of Germany ..... 3810775

[51] Int. Cl.[5] ..... D01H 7/882

[52] U.S. Cl. ..... 57/416

[58] Field of Search ..... 57/400, 401, 404, 414, 57/416, 352; 428/614, 680, 634

[56] References Cited

U.S. PATENT DOCUMENTS 4,397,144 8/1983 Raasch et al. ..... 57/416 X
4,492,077 1/1985 Raasch et al. ..... 57/414
4,662,170 5/1987 Raasch ..... 57/416
4,663,929 5/1987 Raasch et al. ..... 57/416

FOREIGN PATENT DOCUMENTS 0031034 9/1985 European Pat. Off. .
3339852 5/1985 Fed. Rep. of Germany .

*Primary Examiner*—Joseph J. Hail, III
*Attorney, Agent, or Firm*—Shefte, Pinckney & Sawyer

[57] ABSTRACT

A fiber or yarn contacted element of a textile machine, such as a rotor of an open-end spinning machine or the like, has, at the fiber or yarn coating surface, a body portion of steel, a boronized layer formed on the body portion, an alpha-iron layer formed on the boronized layer and a nickel coating layer. A process for producing a fiber or yarn contacted element of a textile machine includes boronizing a steel body portion to form a boronized surface thereon, heating the steel body portion in an atmosphere including nitrogen to methanol to produce an alpha-iron layer, quenching and heating the steel body portion and applying a nickel coating thereto.

7 Claims, 1 Drawing Sheet

PROCESS FOR FORMING A FIBER OR YARN CONTACTED ELEMENT OF A TEXTILE MACHINE

BACKGROUND OF THE INVENTION

The present invention relates to a process for forming a fiber or yarn contacted element of a textile machine, and, more particularly, to a process for forming a rotor of an open-end spinning machine or the like.

In German Offenlegungsschrift No. 33 39 852, a rotor of an open-end spinning machine is disclosed in which the inner, bell-shaped portion, which is contacted by the fibers, is provided with a boron treated oversurface which has a coating thereon composed of nickel with embedded hardened particles. A coated surface of this type improves the wear resistance of the rotor and facilitates a quality spinning operation. However, experience has shown that, occasionally, microflaws develop in the layers composing the rotor which can detrimentally affect the quality of the spinning.

SUMMARY OF THE INVENTION

The present invention provides a fiber or yarn contacted element, such as a rotor of an open-end spinning machine or the like, which has an enhanced quality wear resistant surface.

Briefly described, the present invention provides a fiber or yarn contacted element of a textile machine, such as a rotor of an open-end spinning machine or the like, having a plurality of layers at the fiber of yarn contacting surface thereof. The element has a body portion of steel, a boronized layer formed on the body portion, an alpha-iron layer formed on the boronized layer and a nickel coating layer, the alpha-iron layer being disposed intermediate with the nickel coating layer and the boronized layer. Preferably, the alpha-iron layer has a thickness in the range of approximately 0.5 to 8 microns. The nickel layer preferably includes hardened particles, such as diamond particles, embedded therein.

The present invention also provides a process for producing the aforesaid fiber or yarn contacted element that includes boronizing a steel body portion of the element by annealing the body portion after treating a surface thereof with boron to form a boronized layer on the steel body portion, heating the steel body portion in an atmosphere including nitrogen and methanol to produce a layer of alpha-iron on the boronized surface and quenching the steel body portion. The process additionally includes heating the steel body portion in a vacuum oven, applying a nickel coating to the alpha-iron layer of the body portion and heat-treating the body portion. Preferably, the ratio of methanol to nitrogen in the atmosphere is in the range of approximately 1 to 2000 to 1 to 2400 liters per hour. In the preferred embodiment the range is approximately 1 to 2180 liters per hour. The applying of a nickel coating preferably includes applying a nickel coating having hardened particles such as diamond particles, embedded therein.

DETAILED DESCRIPTION OF THE PREFERRED EMBODIMENT

Figure 2:
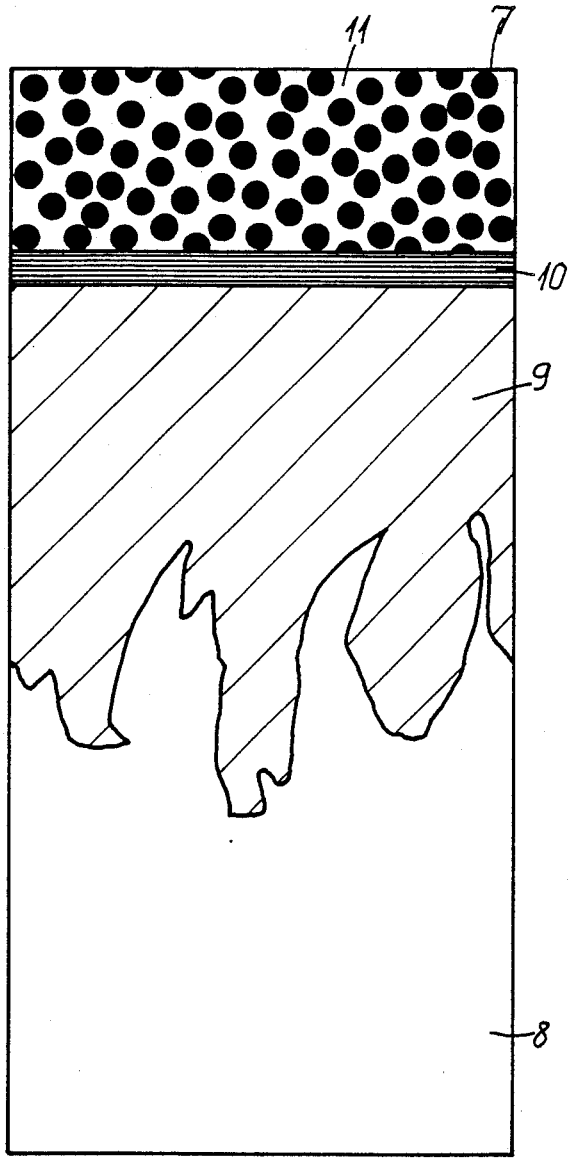
FIG. 2 is an enlarged sectional view of the inner surface of the rotor shown in FIG. 1.
Figure 1:
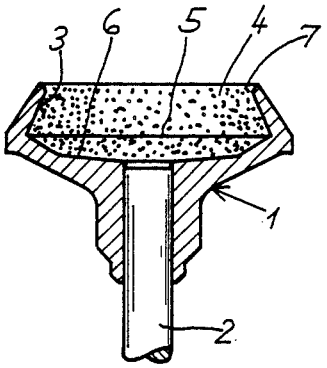
FIG. 1 is a vertical sectional view of a rotor of an open-end spinning machine of the preferred embodiment of the present invention.

In FIGS. 1 and 2, a rotor 1 of an open-end spinning machine or the like formed according to the process of the present invention is illustrated. The rotor 1 is formed of a metal and is press-fitted onto a rotor drive shaft 1 of an open-end spinning unit (not shown). The rotor 1 is formed out of a metal such as steel and has a rotor cavity 3 which defines a conically shaped yarn contacting surface 4. The lower edge of the conically shaped yarn contacting surface 4 is defined by a fiber collection groove 5, which operates in the conventional manner for yarn formation. A surface portion 6 extends from the fiber collection groove 5 to define the base of the conically shaped yarn contacting surface 4.

As shown in FIG. 2, the rotor cavity 3 has at the yarn contacting surface 4 a base material 8 of refined automatic steel having a boronized outer layer 9 and an alpha-iron layer 10 formed on the outer layer 9. A nickel coating 11, having hardened particles 7 embedded therein is formed on the alpha-iron layer 10. The exterior surface of the nickel coating 11 defines the yarn contacting surface 4.

The rotor 1 is formed in accordance with the method of the present invention in the following manner. The base material 8 is subjected to a boronizing process as a result of which the outer layer 9 is formed of relatively coarse crystal structure of $Fe_2B$. That is, the base material is subjected to a treatment with boron such as, for example, a treatment wherein a boron powder is distributed on one surface of the base material 8 and the base material is then annealed. The outer layer 9 is relatively strongly interconnected with the non-boronized portion of the base material 8. The thickness of the outer layer 9 is approximately in the range of about 25 to 75 microns.

The alpha-iron layer 10 is formed on the outer layer 9 by the particular boronizing process utilized. The alpha-iron layer 10 is preferably of a thickness approximately in the range of 2–4 microns and exhibits a very fine crystalline structure. The nickel coating layer 11 has a thickness of approximately 25 microns and the hardened particles embedded therein can be, for example, boron carbide, silicone carbide or, preferably, diamond particles. A cross-sectional dimension of the hardened particles is in the range approximately between 1–6 microns and is preferably in the range of approximately 1–3 microns.

With further reference now to the manufacturing process of the rotor 1, the rotor is composed of free cutting steel which is treated with boron in a conventional manner. The carbon content of the automatic steel lies in the range of approximately 0.4–0.48%. After the boron treatment of the refined automatic steel, the rotor is refined—that is, the rotor is hardened and tempered. During the hardening, the oven atmosphere is adjusted so that a transformation of the iron-boron bonding in one layer thereof occurs so as to create an alpha-iron layer of preferably a thickness in the range of approximately 2–4 microns. A relatively large percentage of the oven atmosphere is composed of nitrogen and a relatively low percentage of the oven atmosphere is composed of methanol. For example, an oven atmosphere for treatment of a rotor in accordance with the present invention has been used in which the ratio of methanol to nitrogen equaled 1:2180 liters per hour. The carbon dioxide portion of the oven atmosphere preferably amounts to approximately 14.4% and the nitrogen percentage amounts to approximately 56.7%. The temperature for hardening was approximately 820° (Celsius) when measured at a ten minute stop time. Accordingly, the treatment of the rotor 1 in accordance with the method of the present invention produced a transformation of the $Fe_2B$ molecules to $Fe_2$ molecules and alpha-crystalline iron.

After the hardening of the rotor 1, the rotor was quenched in an oil bath and thereafter tempered in a vacuum oven having an oven atmosphere of approximately 380° (Celsius).

After the formation of the alpha-iron layer 10, the nickel coating 11 with diamond powder embedded therein, was applied to the alpha-iron coating 10 to a thickness of approximately 25 microns. Thereafter, the rotor 1 was subjected to a warming treatment at approximately 350° (Celsius) for approximately two hours in an oven to achieve solidification of the nickel coating 11. Following the warming treatment, the rotor 1 was subjected to a cleaning process in which glass beads of approximately 40–80 microns diameter were impacted against the rotor. The cleaning process cleans the outer surface of the rotor 1 and dislodges the hardened particles which are not relatively firmly secured to the surface 4. Accordingly, only hardened particles which are firmly anchored in the surface 4 remain in the rotor 1, thereby contributing to the optimization of the spinning process.

Although the forming of the alpha-iron layer in a rotor of an open-end spinning unit has been described herein, the present invention contemplates the use of such an alpha-iron forming process for other boron treated surfaces which are coated with a nickel coating. Additionally, the present invention contemplates the formation of alpha-iron layers in rotor having an outer surface which does not include hardened particles.

The formation of an alpha-iron layer in the order of magnitude of only a few microns, such as in the range of 0.5–8 microns and preferably in the range of approximately 2–4 microns, produces a layered thickness which represents only a relatively small portion of the boric layer of the rotor and, advantageously, is produced without additional processing steps during hardening of the rotor. A further advantage of the alpha-iron coating is that it functions as a buffer between the boronized layer and the nickel coating to optimally compensate for various properties of the base material and the nickel coating disposed thereon such as, for example, the differing expansion and contraction properties of the two materials.

The relatively thin layer of alpha-iron advantageously protects the boronized layer 9, during the hardening process, from the formation of undesirable splits or fissures therein. Since the alpha-iron layer is softer than the layers contiguous thereto it has the capability to absorb or adjust to the changes in the tension which occur due to the differing expansion characteristics of the two layers between which it is disposed. In this manner, damage to the boronized outer layer 9 of the rotor 1 can be avoided as well as the occurrence of splits or fissures in the nickel coating.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A fiber or yarn contacted element of a textile machine having a plurality of layers at the fiber or yarn contacting surface thereof, comprising:

an inner body portion of steel;

a boronized layer formed on said body portion;

an alpha-iron layer formed on said boronized layer; and a nickel coating layer, said alpha-iron layer being disposed intermediate said nickel coating layer and said boronized layer.

2. A fiber or yarn contacted element according to claim 1 and characterized further in that said nickel coating layer defines the fiber or yarn contacted surface.

3. A fiber or yarn contacted element according to claim 1 and characterized further in that said alpha-iron layer has a thickness in the range of approximately 0.5 to 8 microns.

4. A fiber or yarn contacted element according to claim 3 and characterized further in that said alpha-iron layer has a thickness in the range of approximately 2–4 microns.

5. A fiber or yarn contacted element according to claim 1 and characterized further in that said nickel coating layer includes hardened particles embedded therein.

6. A fiber or yarn contacted element according to claim 5 and characterized further in that said hardened particles are diamond particles.

7. A fiber or yarn contacted element according to claim 1, wherein the yarn contacted element is a rotor of an open-end spinning machine.

* * * * *